United States Patent [19]

Demler, Jr. et al.

[11] Patent Number: 4,881,905

[45] Date of Patent: Nov. 21, 1989

[54] HIGH DENSITY CONTROLLED IMPEDANCE CONNECTOR

[75] Inventors: Henry W. Demler, Jr., Clearwater; Frank P. Dola, Hudson; David J. Kimmel, Clearwater; John H. Lauterbach, Hudson; Thomas J. Sotolongo, Clearwater Beach; Grover A. Zwieg, Clearwater, all of Fla.

[73] Assignee: AMP Incorporated, Harrisburg, Pa.

[21] Appl. No.: 96,792

[22] Filed: Sep. 11, 1987

Related U.S. Application Data

[63] Continuation of Ser. No. 866,518, May 23, 1986, abandoned.

[51] Int. Cl.[4] ..... H01R 23/70

[52] U.S. Cl. ..... 439/79; 439/101; 439/608

[58] Field of Search ..... 339/14 R, 17 R, 17 LC, 339/17 LM, 17 M, 143 R, 176 MP; 439/92, 101, 108, 59–62, 79, 80, 607, 608, 609

[56] References Cited

U.S. PATENT DOCUMENTS

| | | | |
|---|---|---|---|
| 2,418,729 | 4/1947 | Schemers | 174/153 |
| 2,438,572 | 3/1948 | McCormack | 174/153 |
| 3,323,083 | 5/1967 | Ziegler . | |
| 3,350,666 | 10/1967 | Ziegler . | |
| 3,413,594 | 11/1968 | Fernald et al. | 339/17 LC |
| 3,460,072 | 8/1969 | Ziegler . | |
| 3,634,816 | 1/1972 | Zell | 339/17 M |
| 3,651,432 | 3/1972 | Henscher et al. . | |
| 3,709,772 | 1/1973 | Rice | 164/98 |
| 3,871,728 | 3/1975 | Goodman . | |
| 4,131,328 | 12/1978 | Minar et al. | 339/14 R |
| 4,223,968 | 9/1980 | Kawabata et al. . | |
| 4,243,093 | 1/1981 | Nieman | 164/98 |
| 4,261,630 | 4/1981 | Knappenberger | 439/912 |
| 4,293,182 | 10/1981 | Schwartz . | |
| 4,389,625 | 6/1983 | Sladek et al. . | |
| 4,451,107 | 5/1984 | Dola et al. . | |
| 4,550,762 | 11/1985 | West et al. | 164/98 |
| 4,552,422 | 11/1985 | Bennett et al. | 339/17 CF |
| 4,560,221 | 12/1985 | Olsson | 339/176 MP |
| 4,616,893 | 10/1986 | Feldman | 339/17 M |

FOREIGN PATENT DOCUMENTS

| | | | |
|---|---|---|---|
| 46-17736 | 10/1971 | Japan | 339/143 R |
| 52-74883 | 6/1977 | Japan | 339/14 R |

OTHER PUBLICATIONS

IBM Bulletin, Arvanitakis, vol. 21, No. 3, p. 955, 8–1978, Copy in 339/14.R.

Teradyne Connection Systems, Inc.; Technical Bulletin No. 237; pp. 8,9, 1–1985.

*Primary Examiner*—Neil Abrams

*Attorney, Agent, or Firm*—Robert W. Pitts

[57] ABSTRACT

A high speed, high density, controlled impedance connector for use between printed circuit boards is disclosed. The connector provides for both power and signal transmission. Closely spaced signal terminals are surrounded by dielectric sleeves positioned in an array, and the plural dielectric sleeves are in turn surrounded by an outer unitary cast conductive housing. The essentially coaxial configuration of the contacts permits minimal variations in the impedance along the length of the signal paths in the connector. The connector is fabricated by first positioning the dielectric sleeves in spaced relationship on prescribed centerlines and subsequently casting or molding the conductive outer housing around the sleeve array.

4 Claims, 18 Drawing Sheets

92
20
6A
90
60
62
64
50
7A
74
72
6A
52
70
30
56
10
82
84
4
48
80
56
88
44
8A
86
46

HIGH DENSITY CONTROLLED IMPEDANCE CONNECTOR

This application is a continuation of application Ser. No. 866,518 filed May 23, 1986 and now abandoned.

BACKGROUND OF THE INVENTION

1. Field of the Invention

This invention relates to high speed, high density electrical connectors for use in transmitting high frequency signals and more particularly to matched impedance, low crosstalk connectors suitable for use in minimizing transmission delays.

2. Description of the Prior Art

As the requirements for increased speed in electronic equipment, such as computers, becomes ever more stringent, the limiting factor appears to be the actual signal transmission time in the various signal lines that must be employed in computer systems. As the speeds at which computer systems are required to operate continues to increase, the circuit density has to be concurrently expanded. These increases in speed and density cannot be achieved without suitable electrical connectors employed between printed circuit boards, wires, and other transmission lines employed to interconnect various components of computer systems.

Electrical connectors almost inevitably introduce mechanical and electrical discontinuities in transmission circuits. At high frequencies, the discontinuities introduced by electrical connectors can serve to significantly reduce the signal transmission speed. Abrupt changes in the shape of conductive paths or dielectric materials, which are virtually inevitable upon introduction of electrical connectors, can result in a change in the characteristic impedance of the conductive path. These changes in conductive diameters represent discontinuities which behave as capacitances shunting the conductive paths at each point in a connector where the diameter change occurs.

An ideal connector for interconnecting separate components of a transmission path would be at least as good with respect to signal distortion and energy loss as that of the physical components comprising the particular transmission path. Ideally, a given connector should be physically identical to an incremental length of the transmission path to satisfy this requirement. However, exact conformity is difficult if not impossible to achieve due in part to such considerations as the mechanical integrity of the interconnection and the suitability of various dielectric materials for use in a connector. The geometric mismatch of the connector, as compared to the transmission path, creates an impedance mismatch. The impedance mismatch in turn creates an energy reflection. When a signal passing along a line of one impedance encounters a section of a line of different impedance, for example due to geometric mismatch, there is a reflection of a portion of the signal where the impedance changes. The greater the frequency, generally the greater the reflected signal. Furthermore, the length of the mismatched line in conjunction of the frequency of the signal is significant. If the length of the mismatch is less than one half a wave length, the effect of the impedance mismatch tends not to be as significant. For higher frequencies, however, impedance mismatching can become a significant problem.

The effect of impedance mismatching in coaxial connectors is discussed in greater detail in U.S. Pat. No. 3,350,666, U.S. Pat. No. 3,460,072 and U.S. Pat. No. 3,651,432. Those discussions of the effect of impedance mismatching are incorporated herein by reference. Impedance mismatches can result in significant signal distortion as well as potential propagation delay, thus affecting the performance of transmission paths. Controlled matched impedance connectors are, therefore, necessary for high speed signal transmission in such applications as large high speed computers.

It is possible to provide compensation for impedance mismatching. One such compensation technique involves the introduction of compensating impedance variations adjacent an impedance mismatch caused by the presence of an electrical connector. U.S. Pat. No. 3,323,083; U.S. Pat. No. 3,350,666; U.S. Pat. No. 3,460,072; and U.S. Pat. No. 4,389,625, each disclose impedance compensation techniques involving changes in the impedance over various lengths of a transmission path to compensate for the mismatch impedance which occurs in a coaxial connector. Other techniques which have been employed in matched impedance connectors involve the introduction of a compensating impedance, such as a compensating capacitance. For example, additional capacitance can be added by introducing additional grounding surfaces. One example of a connector which adds a compensating capacitance by the addition of conductive pads common to a ground plane is that shown in U.S. Pat. No. 3,651,432. Strip line or microstrip connectors rely upon a continuous ground plane to maintain a constant impedance. U.S. Pat. Nos. 3,871,728 and 4,223,968 are examples of matched impedance printed circuit board connectors employing additional ground planes. Although connectors of this type may exhibit a substantially constant impedance, the crosstalk between signal lines can be quite significant. Furthermore, these connectors do not provide shielding from extraneous radiation, such as electromagnetic interface (EMI) and radio frequency interference (RFI).

Of course, in other connectors, alternating ground and signal configurations, similar to those employed in high speed transmission cables, are continued in the connector. It will be appreciated, however, that the addition of ground paths in the connector itself substantially reduces the density which may be attained in a given connector.

U.S. Pat. No. 4,451,107, incorporated herein by reference, discloses a connector having a die cast housing, dielectric sleeves, and die cast terminals within the dielectric sleeve. The die cast housing is formed of zinc, which acts as a shield to attenuate unwanted electromagnetic interference and to provide a high speed connector without the use of grounding terminals. In that connector, the dielectric sleeves are molded into apertures in the die cast housing. The terminals are subsequently die cast into openings formed in the dielectric sleeves. Modular components can then be mounted on printed circuit boards to provide the desired impedance characteristics through the length of the connector assembly. The connector disclosed therein does, however, have certain drawbacks. The use of die cast terminals has proven unsatisfactory, due in part to the metallurgy of the die cast materials, such as zinc, used to form the terminals. Furthermore, the right angle configuration disclosed therein inevitably creates certain impedance variations at the terminal bend. The suitability of that approach to high density connectors is also limited, due to the difficulty of die casting the extremely thin walls between adjacent terminals.

SUMMARY OF THE INVENTION

A high density, low crosstalk, high speed impedance matched electrical connector is fabricated by positioning a plurality of dielectric sleeves in a mold and die casting or molding a conductive housing around the dielectric sleeves. In the preferred embodiment, a unitary housing contains arrays of signal and power terminals within the individual dielectric sleeves.

An essentially coaxial configuration is formed with each terminal separated from the conductive housing by the dielectric. This coaxial configuration facilitates maintenance of a constant impedance through the connector. Compensation is easily made for impedance changes due to necessary dimensional changes, such as the overlap of male and female terminals upon mating and right angle bends to facilitate interconnection of orthogonal printed circuit boards. Compensation is made by simply locally varying the spacing between the terminal and the surrounding housing. This change in shape is accomplished by changing the shape of the molded dielectric sleeve and then casting or molding the thin wall conductive housing around the exterior of the dielectric sleeve.

This invention permits the interconnection of orthogonal printed circuit boards in a matched impedance configuration. Signal terminals in a mother board connector comprise pins. Signal terminals in a daughter board connector comprise sockets and extend at right angles to the mother board signal terminals. The increased terminal thickness at the intersection between the socket and pin terminals occurs where the signal path and surrounding housing shield makes a right angle turn. The increase in terminal thickness partially accounts for impedance changes incident to a right angle bend. The preferred embodiment is suitable for interconnection of terminal pads carrying very high frequency signals and positioned on 0.050 inch centerlines. A connector assembly in accordance with the preferred embodiment of this invention could carry 300 amps of power between mother and daughter boards with 60 dB isolation between signal contacts. Such a connector could be 17 inches long and would contain 600 signal terminals for interconnecting signal pads spaced on 0.050 inch centerlines. The walls of the conductive housing between signal terminals, which provide isolation, signal return and impedance control can be formed of a die cast metal such as tin or a tin-silver alloy and would be 0.010 inches thick.

BRIEF DESCRIPTION OF THE DRAWING

FIG. 3 is a sectional view of the mother board connector.

FIG. 23 is a view of an alternate embodiment of a matched impedance connector for interconnecting parallel printed circuit boards.

DETAILED DESCRIPTION OF THE PREFERRED EMBODIMENT

The electrical connector comprising the preferred embodiment of the invention depicted herein is a high speed, high density matched impedance connector having low crosstalk between adjacent signals. This connector is capable of establishing an interconnection between a plurality of separate signal and power paths on separate components such as printed circuit boards. The dimensions of the components of this connector can be chosen to match the impedance in the transmission lines interconnected such that any impedance discontinuity incidental to the interconnection can be minimized.

Figure 1:
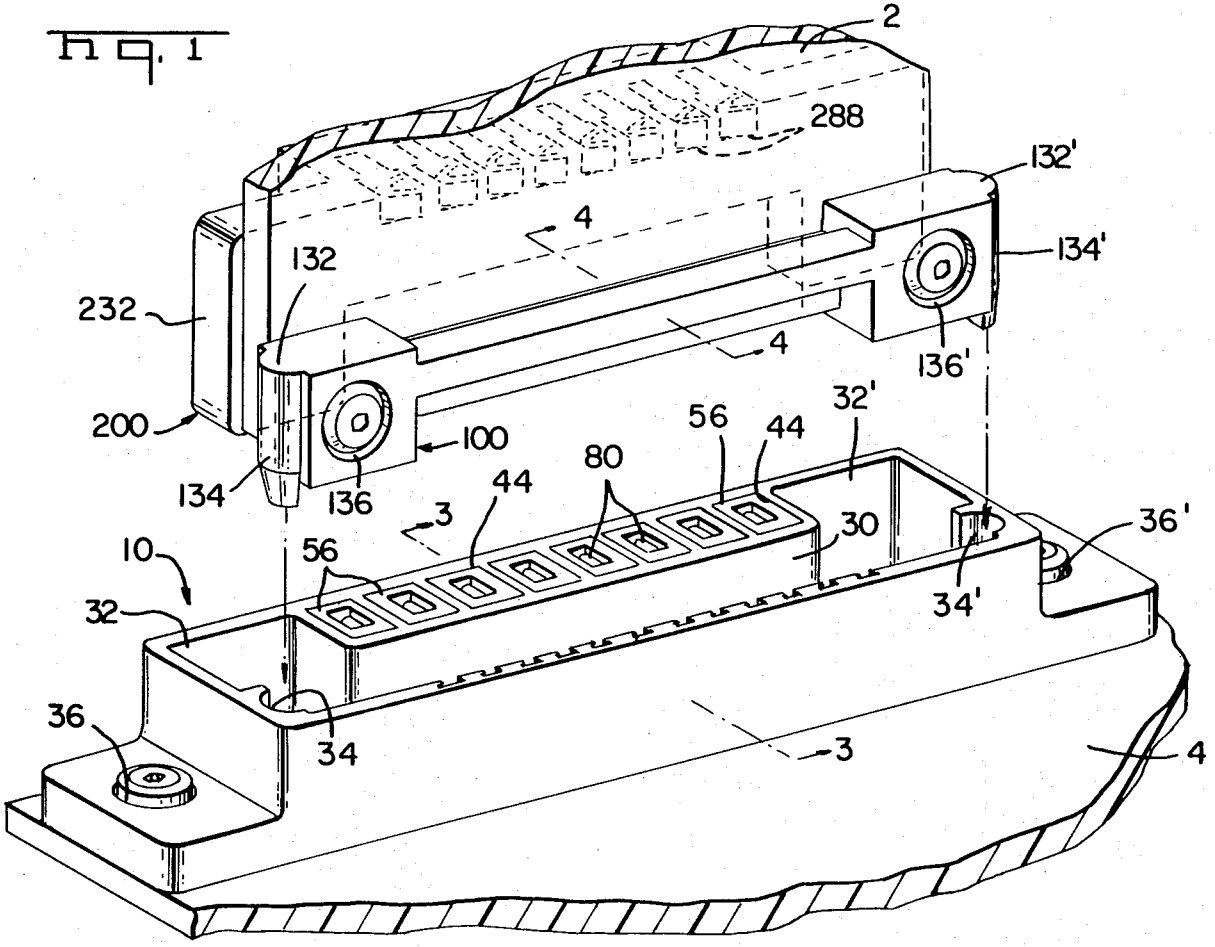
FIG. 1 is perspective view showing matable mother and daughter board connectors in accordance with the preferred embodiment of this invention.

FIG. 1 shows the basic elements of this invention adapted to a connector assembly for interconnecting signal and power traces on a daughter board 2 to corresponding and signal traces on a mother board 4. This connector assembly includes a single mother board connector 10 attached to the mother board 4. This mother board connector includes a separate array of power interconnection elements 80 and an array of signal interconnection elements 60, 70. A subassembly including a daughter board signal connector 100, and a daughter board power connector 200, are attached to the daughter board 2. The subassembly consisting of connectors 100 and 200 attached at the end of the daughter board 2 is insertable into mating relationship with the mother board connector 10.

Figure 2:
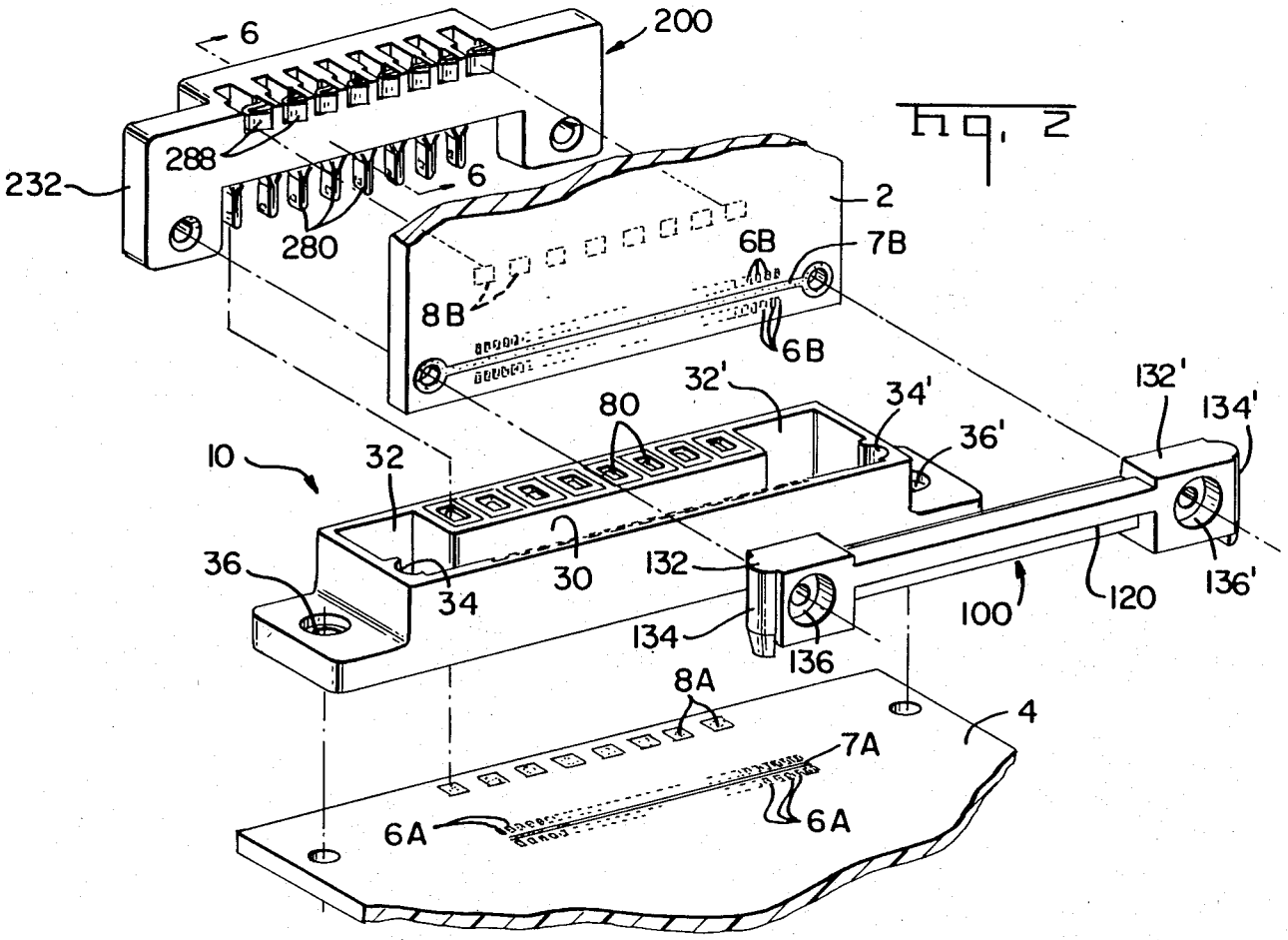
FIG. 2 is an exploded perspective view of the connectors shown in FIG. 1.
Figure 1:
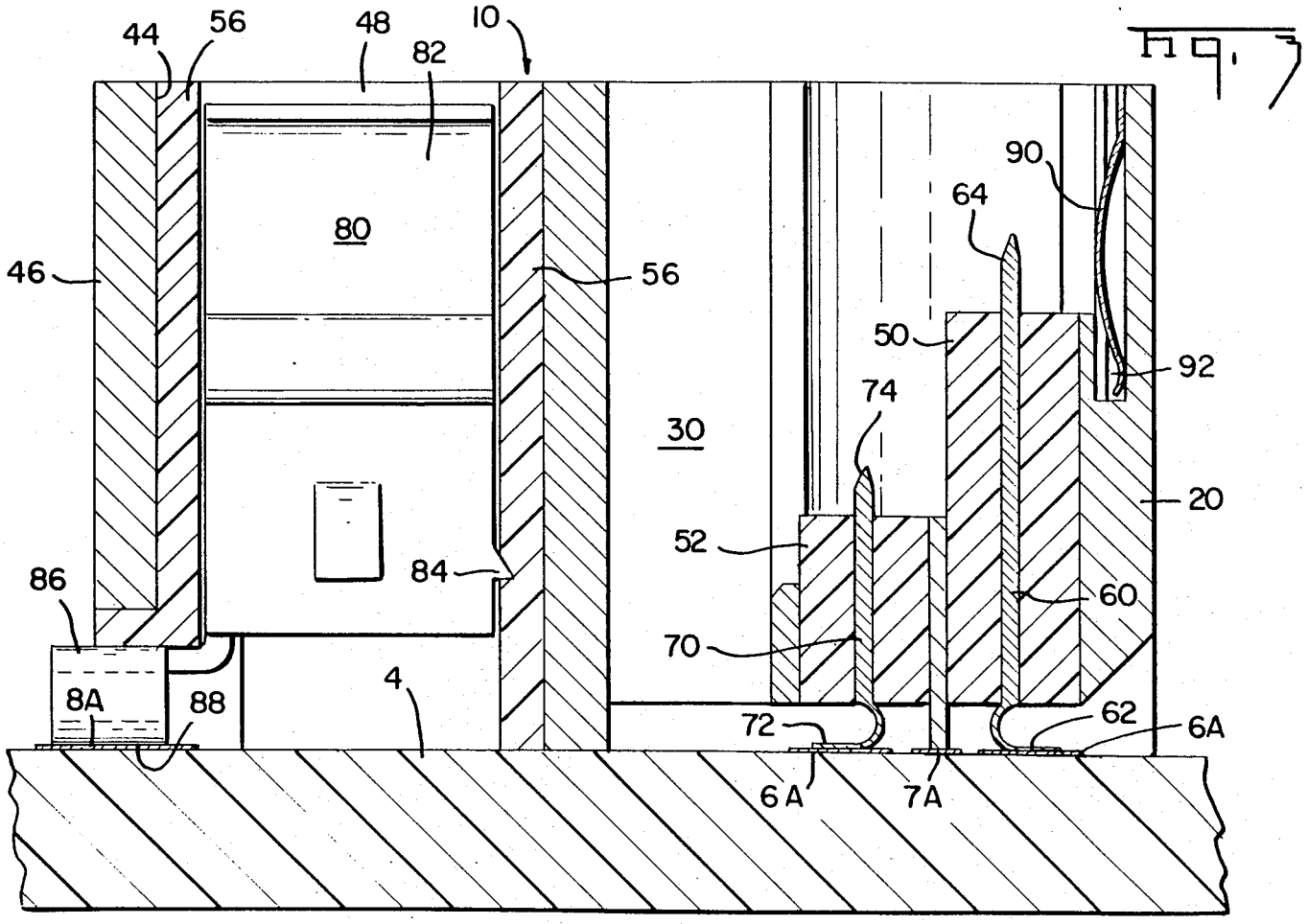

FIG. 2 is an exploded perspective view of the various components of the connector assembly illustrating the manner in which connectors 10, 100, and 200 are attached to the daughter board 2 and the mother board 4 in order to establish interconnection to signal pads *6a* and *6b* and power pads *8a* and *8b* located on the mother board 4 and the daughter board 2 respectively. The signal pads *6a*, located on mother board 4, are spaced from the power pads *8a*. As shown in FIG. 2, the signal pads 6*a* are positioned in two separate rows. The signal pads 6*a* are not only significantly smaller than the power pads 8*a*, but are also much more closely spaced. Separation between the centerlines adjacent signal pads in one embodiment of this invention is on the order of 0.050 inches. Separation between adjacent power pads is on the order of 0.250 inches. A grounding strip 7*a* commoned to the grounding planes in the mother board 4 extends between the two rows of signal pads and is connected to the housing 100. An array of signal traces 6*b* is located on one side of the daughter board 2. Adjacent rows of signal traces 6*b* are separated on the daughter board by an intermediate ground trace 7*b* similar to that for the mother board. In this embodiment of the invention, the power pads 8*b* are located on the opposite surface of the daughter board 2 from the signal traces 6*b*. A ground plane located within the daughter board 2 would provide a reference plane for impedance matching within the printed circuit board.

Each of the separate connectors 10, 100, and 200 comprising this assembly, include three principal elements. Each separate connector contains a plurality of individual terminals located in an array corresponding to the conductive traces on the respective daughter board 2 or mother board 4. Each terminal is in turn positioned within a terminal receiving cavity of a dielectric sleeve. The dielectric sleeves are in turn located within pockets formed in a unitary housing formed of a conductive material, such as a die cast metal housing. The outer conductive housing extends not only in surrounding relationship to the array of terminals and associated dielectric sleeves, but also encircles or surrounds each individual dielectric sleeve such that each terminal is laterally surrounded by a conductive shield with the terminals and the conductive shields being separated by the intermediate dielectric sleeves. The interrelationship between terminals, dielectric sleeves, and the outer conductive housing, is shown with respect to the mother board connector 10 by the sectional view of FIG. 3 in conjunction with the elevational sectional view of FIG. 13 and the plan view of FIG. 14. An array of signal terminals 60 and 70 are positioned in a signal portion of mother board connector 10 separated from an array of power terminals 80 by an intermediate slot 30. The slot 30, best shown in FIG. 14, extends between cavities 32 and 32'. Cavities 32 and 32' are dimensioned to receive the end portions of the daughter board connectors 100 and 200 and the intermediate slot 30 is positioned to receive the lower edge of the daughter board 2. The array of signal terminals includes one outer row of signal terminals 60 and an inner row of signal terminals 70. In this embodiment of the invention, the outer row of signal terminals 60 are longer than the signal terminals 70 in the inner row. Terminals 60 are generally rectangular in cross section and have a tapered section 64 at one end and a surface mount foot 62 suitable for reflow soldered interconnection to the outer row of signal pads 7*a*. The inner row terminals 70 also include a tapered portion 74 at one end and a surface mount foot 72 at the opposite end. In the preferred embodiment of this invention, the signal terminals 60 and 70 are formed of a high copper alloy such as any number of high copper alloys manufactured by Olin Brass, Olin Corporation. Other materials such as beryllium copper could also be employed. Power terminals 80 are located in a separate power section of the mother board connector 10. Each of the power terminals 80 includes separate spaced apart spring biased wings 82 and 82'. An integral contact leg 86 having a contact foot 88 provides means for surface mount reflow solder interconnection to the power pads 8*a*. Retention barbs 84 and 84' formed on wings 82 and 82' retain the individual power terminals within associated dielectric sleeves.

Figure 8:
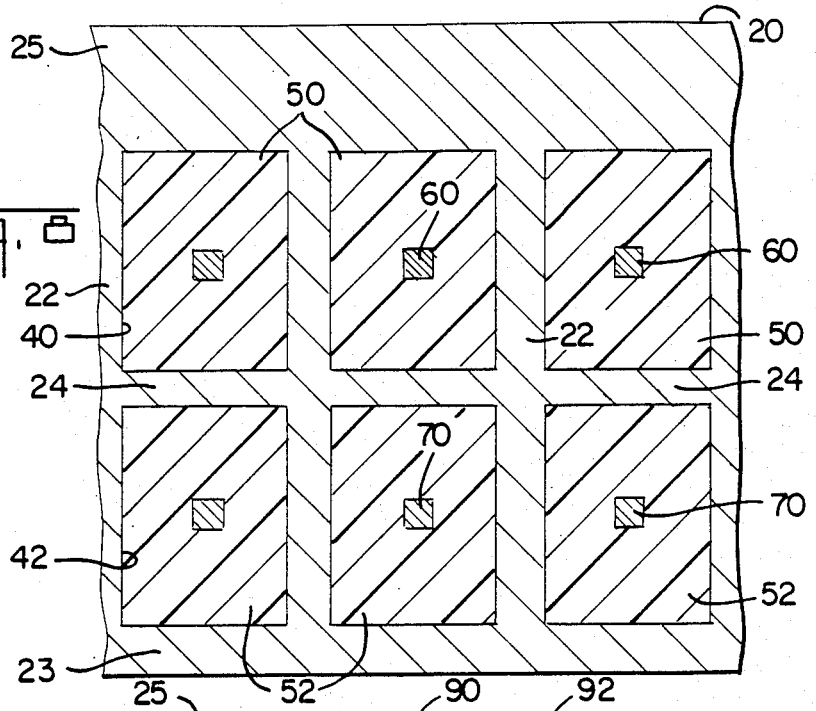
FIGS. 8, 9, and 10 are sectional views taken along section 8—8; 9—9 and 10—10 in FIGS. 7 and 4.

As shown in the sectional view of FIG. 3, individual signal pins 60 and 70 are located within separate dielectric sleeves 50 and 52. The dielectric sleeves 50 and 52 each have a terminal receiving cavity generally centrally disposed therein. Each dielectric sleeve 50 and 52 extends along the major portion of the length of the respective terminals 60 or 70. In each case, the surface mount foot 62 or 72 extends below the lower face of the respective dielectric sleeve 50 or 52 and the upper tapered portion 64 and 74 extends beyond the upper face of the corresponding dielectric sleeve. As best shown in FIG. 8, each dielectric sleeve 50 and 52 is generally rectangular in cross section and is received within a respective pocket 40 and 42 of the outer housing 20. The sleeves can be fabricated from a material having a high dielectric strength or low dielectric constant. Suitable dielectric materials would be methylpentene polymer or polytetrafluoretheylene. The respective pockets 40 and 42 also have a generally rectangular cross section and conform to the outer contour of the corresponding dielectric sleeves 50 and 52. Pockets are defined by a plurality of walls or ribs 22 extending orthogonally between laterally extending walls 23, 24, and 25. The dielectric sleeves 50 and 52 not only separate the terminals 60 and 70 from the walls 23, 24, and 25, but also maintain a prescribed spacing between the terminals 60 and 70 and the conductive walls 23, 24, and 25 which form a common ground. As such, the terminals 60 or 70 and dielectric 50 or 52 in each pocket exhibit a generally coaxial configuration along the length of the terminal 60. When the spacing between the housing walls and the intermediate terminals 60 or 70 remains axially uniform and when the dielectric constant of dielectric sleeves 50 and 52 remains axially uniform, the impedance along the major portion of the respective signal terminals 60 and 70 will remain substantially constant.

Figures 12, 13, 14:
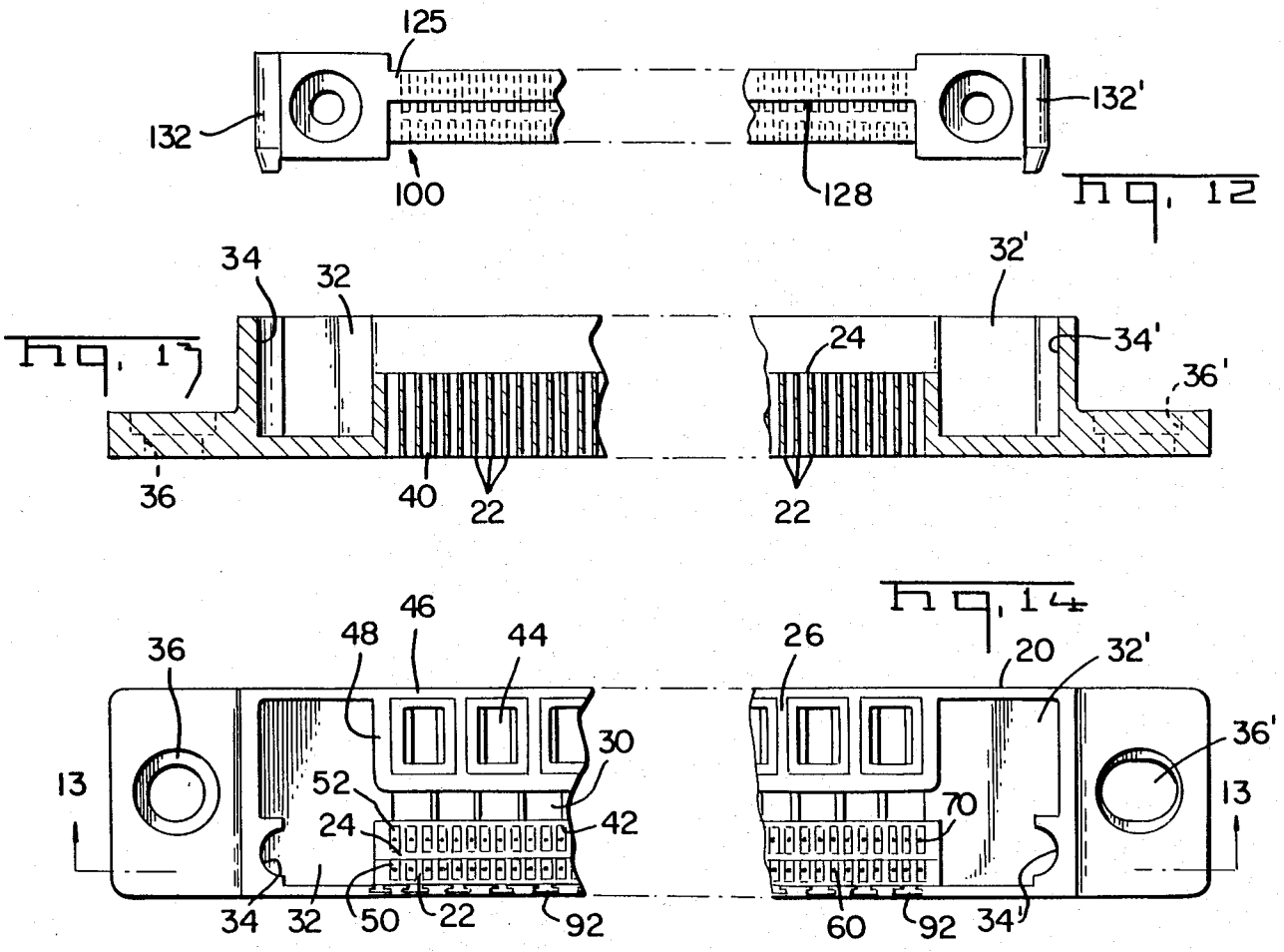
FIG. 12 is a top view of the daughter board signal connector.
FIG. 13 is a side elevational view of the mother board connector with the section taken through signal terminal portion, with the pins removed for clarity.
FIG. 14 is a top plan view of the mother board connector.
Figure 15:
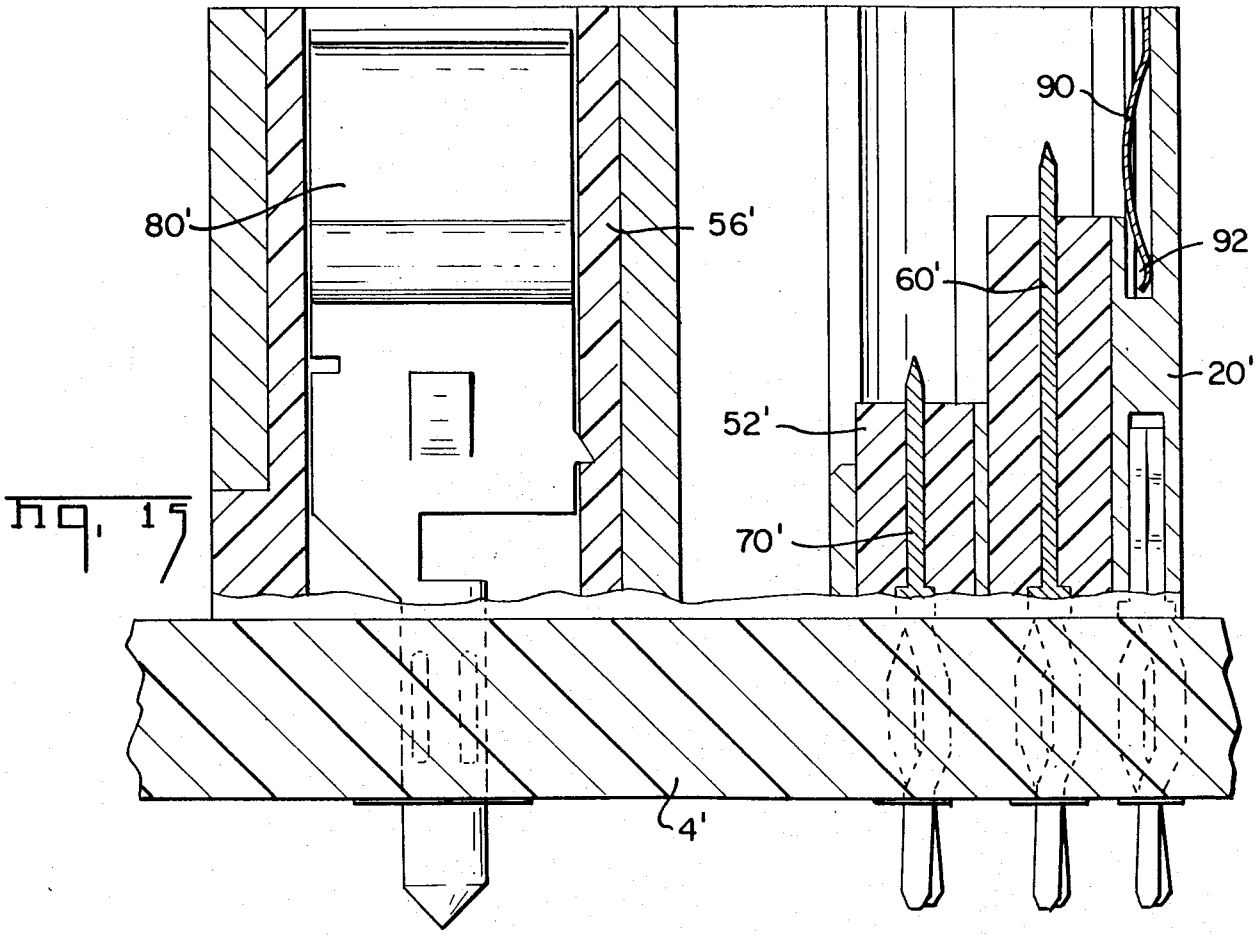
FIG. 15 is an alternate embodiment of the mother board connector having through-hole rather than surface mount terminals.

As shown in FIGS. 1, 3 and 14, the mother board connector 10 contains not only a signal terminal array, but also a power terminal array on the opposite side of slot 30. Power terminals 80 within power dielectric sleeves 56 are positioned within power terminal pockets 44 formed within the unitary cast housing 20. FIG. 3 shows the relationship between power terminals 80 and signal terminals 60 and 70. The power terminal retention bars 84 engage the dielectric sleeves 56. These dielectric sleeves 56 are in turn surrounded by cast walls 46 and 48 in much the same manner as for the signal terminal array. The upper end of the power terminal pockets 44 is open with the power terminal spring contact wings 82 and 82' being disposed to engage a mating contact inserted into the power terminal pocket 44. The surface mount leg 86 and surface mount foot 88 extend from the bottom of the power pocket 44 and are positioned to engage a power pad 8*a*. In the preferred embodiment of this invention, each power terminal is capable of carrying ten amps. A single connector in accordance with this invention could contain 40 power terminals, and 400 amps could be transmitted between boards by this connector.

Whereas the mother board connector 10 contains both signal and power terminals positioned within a single unitary cast housing 20, separate connectors 100 and 200 are employed as signal and power connectors to the traces on daughter board 2. Daughter board signal connector 100 is adapted to mate with the signal terminal array and mother board 10 and daughter board power terminal 200 is similarly adapted to mate with the power terminal array in the mother board connector 10. As shown in FIG. 1, the daughter board signal connector 100 is mounted on an opposite side of daughter board 2 from the daughter board power connector 200.

Signal connector 100 has two rows of signal terminals 160 and 170 received within dielectric sleeves 150, 152, and 154, in turn positioned within an outer cast housing 120. The upper or outer terminals 160 are significantly longer than the lower or inner terminals 170. The outer terminals 160 have an elongate shank 165. A U-shaped female contact socket 164 is located at one end of terminals 160. A surface mount foot 162 suitable for reflow soldering is positioned at the other end of the outer terminal 160. Inner terminal 170 also has a U-shaped female contact portion 174 at one end and a surface mount foot 172 suitable for reflow soldering at the opposite end. The terminals 160 and 170 are also preferably formed of a high copper alloy such as any number of high copper alloys manufactured by Olin Brass, Olin Corporation.

Each of the daughter board signal terminals 160, 170 and its surrounding dielectric sleeve or sleeves 150, 152, 154 is positioned within the outer signal pockets 140 and inner signal pockets 142 respectively. Although located in surrounding relationship to the respective signal terminals 160 and 170, the signal pockets 140 and 142 do not have a simple rectangular cross section. The comparatively complex configuration of signal pockets 140 and 142 is due to the necessity of positioning the U-shaped female contact sockets 164 and 174 within the pocket while still maintaining adequate separation between the terminal mating section and the outer walls of the housing such that an impedance mismatch does not occur at the point where the daughter board signal terminals are mated to the mother board signal terminals. The spacing at this mating point must also take into account that the total thickness of the signal conductor is increased at the point of mating since the sockets 164, 174 overlap the ends 64, 74 of the signal pins 60, 70.

Figure 4:
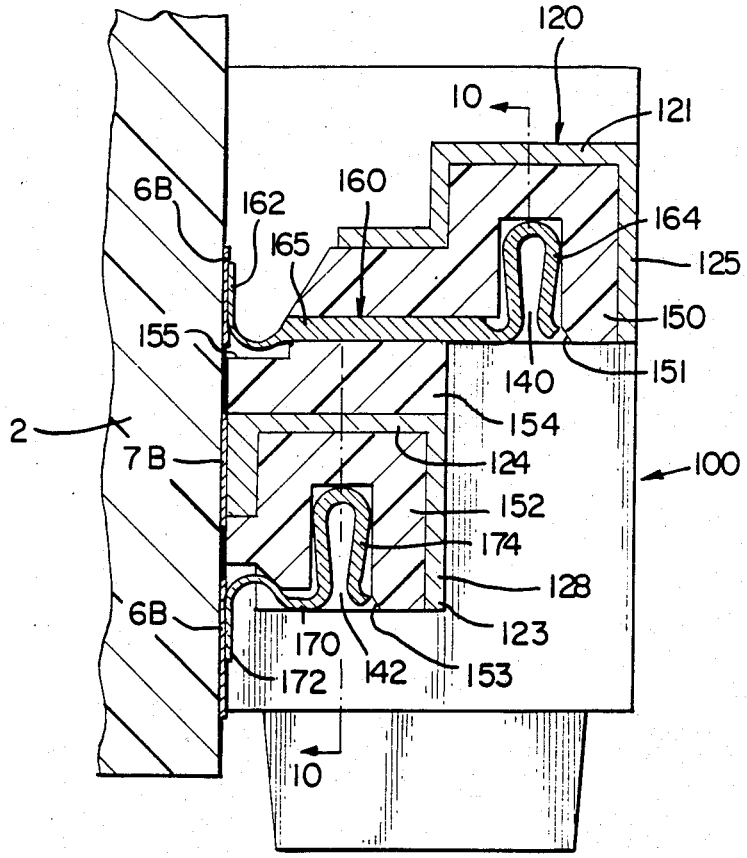
FIG. 4 is a sectional view showing the daughter board signal connector.
Figure 21:
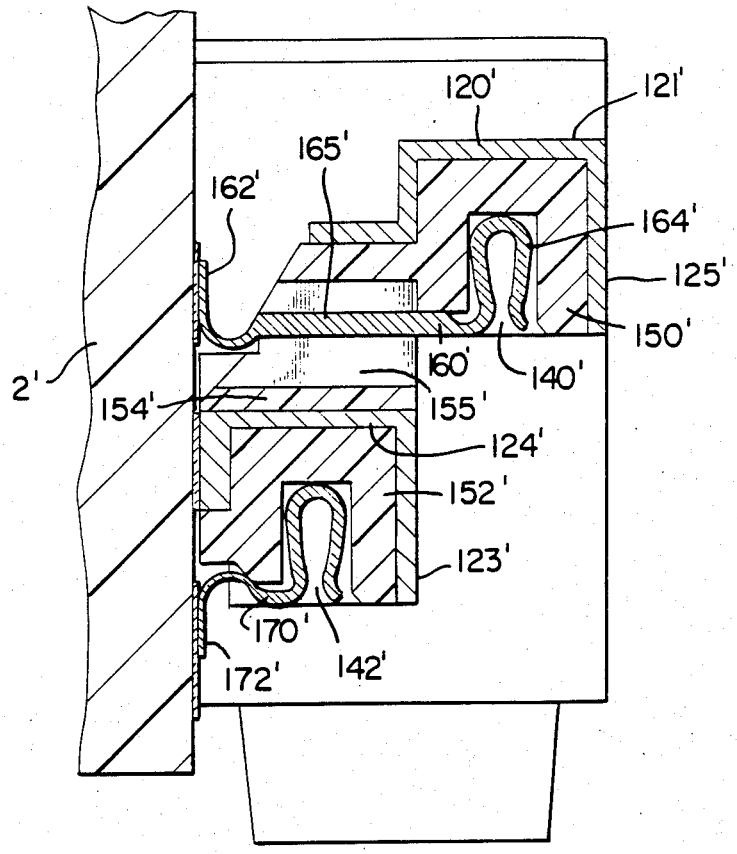
FIG. 21 is a view similar to FIG. 4 showing an alternate dielectric sleeve.

As shown in FIG. 4, the dielectric sleeves surrounding each outer signal terminal 160 comprises a two-piece rather than a one-piece dielectric sleeve. Sleeves 150 and 154 are positioned in adjoining relationship to surround much of the outer signal contact 160. Sleeve 150 has a closed end socket cavity 151 extending inwardly from one face of sleeve 150. This socket cavity provides clearance for receiving the U-shaped socket portion 164 of terminal 160. The other half of the upper signal terminal dielectric sleeve is formed by an insert 154. Sufficient clearance is provided between dielectric sleeve half 150 and insert 154 to provide clearance for the shank portion 165 of the outer signal terminal. Note however, that the portion of the signal terminal shank 165 extending between dielectric sleeve elements 150 and 154 is surrounded on four sides by dielectric material. Sleeve insert 154 has an undercut section 155 which provides clearance for the surface mount foot 162 on terminal 160 as best shown in FIG. 4. An alternate construction of this portion of the daughter board signal connector is shown in FIG. 21. The inner terminal dielectric sleeve 152 also has a socket cavity 153 for receiving U-shaped spring action socket portion 174 of the inner signal terminal 170. The remainder of the terminal 170 extends on the exterior of one face of sleeve 152 but with the exception of the surface mounting foot 172, the terminal 170 is surrounded on three sides by dielectric material in the daughter board signal connector 100.

The daughter board power terminal 200 is configured to mate with the power terminal array in mother board housing 10. Positioned on the opposite side of the daughter board 2 from the daughter board signal connector 100, the daughter board power connector 200 also comprises a unitary metal housing having a plurality of sleeves 256 containing power terminals 280 located within power terminal pockets 244. Power terminals 280 have projecting blades 282 and 282' suitable for insertion between spring contact wings 82 and 82' on the mother board connector 10. Projecting blades 282 and 282' are narrower than spring biased wings 82 and 82'. Therefore, the lateral position of blades 282 and 282' relative to wings 82 and 82' is not critical. Daughter board thickness is, therefore, not critical. The lateral positioning of blades 282 and 282' relative to wings 82 and 82' varies with the daughter board thickness and the wide range possible for this configuration thus accounts for daughter board thickness. These blades extend below the lower face of the power terminal outer housing and the dielectric sleeve 256. Power terminal foot 288, located on the opposite end of terminal 280, is positioned for surface mount soldered engagement to a power pad **8*b*** located on the daughter board.

Figure 7:
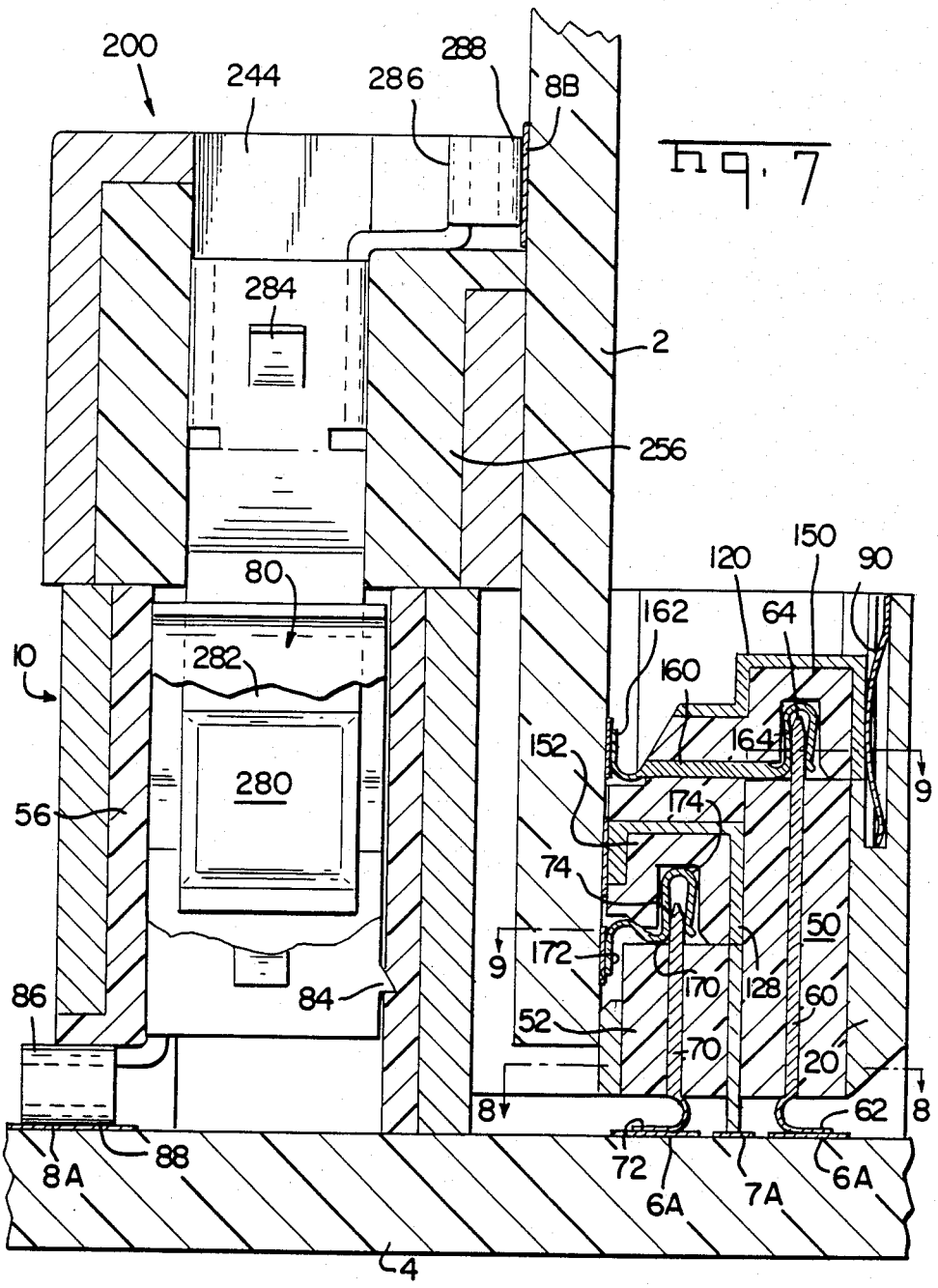
FIG. 7 is a sectional view taken in elevation showing the mated mother board and mother board signal and power connectors.
Figure 9:
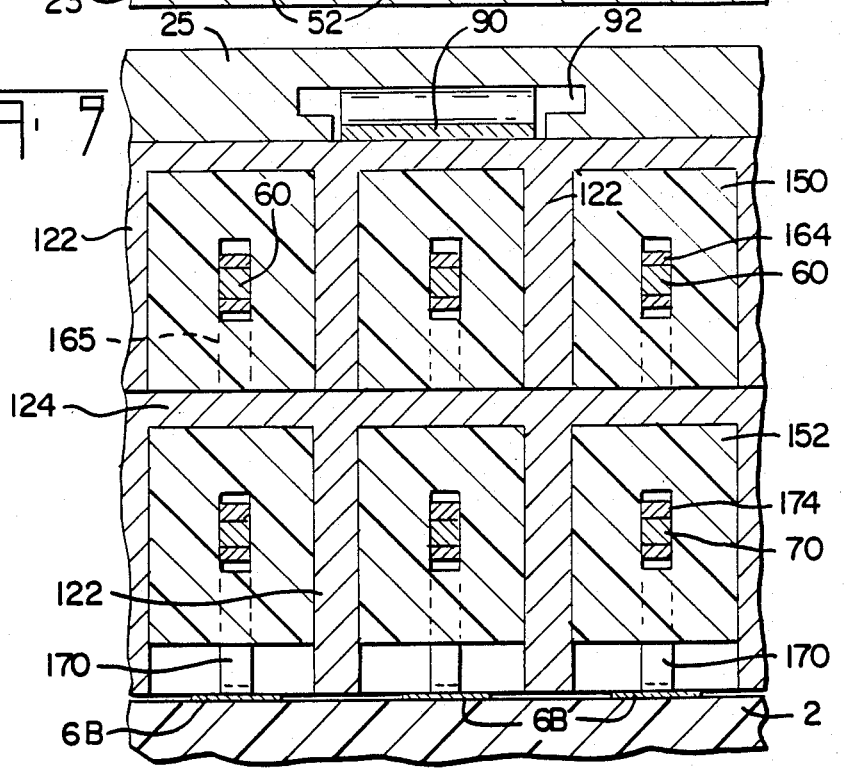
Figure 10:
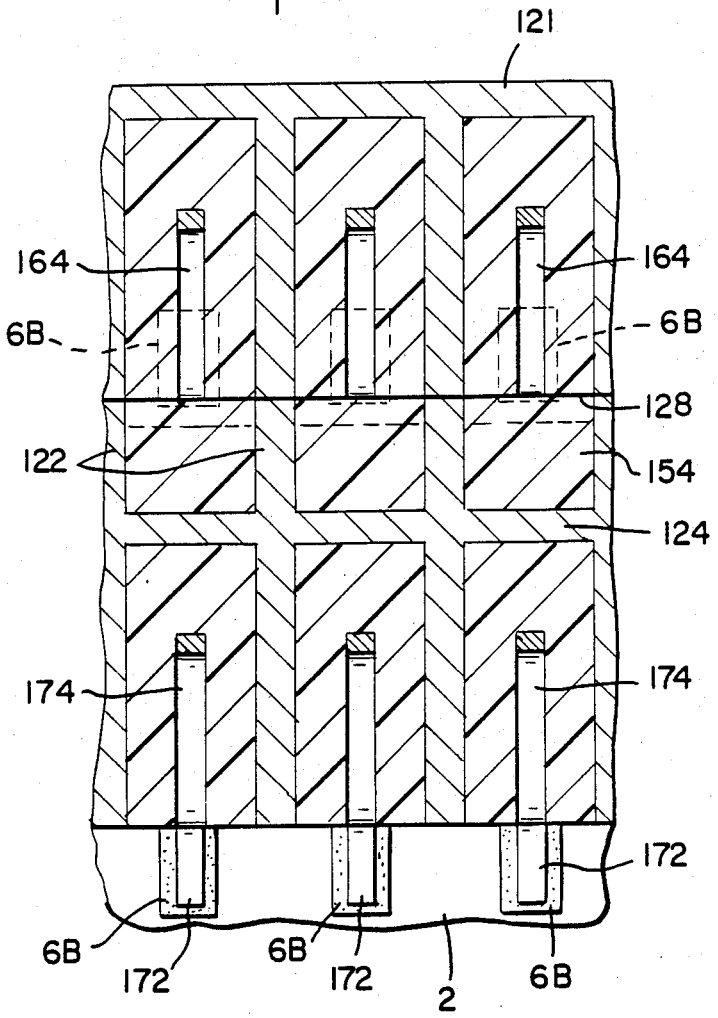
Figure 11:
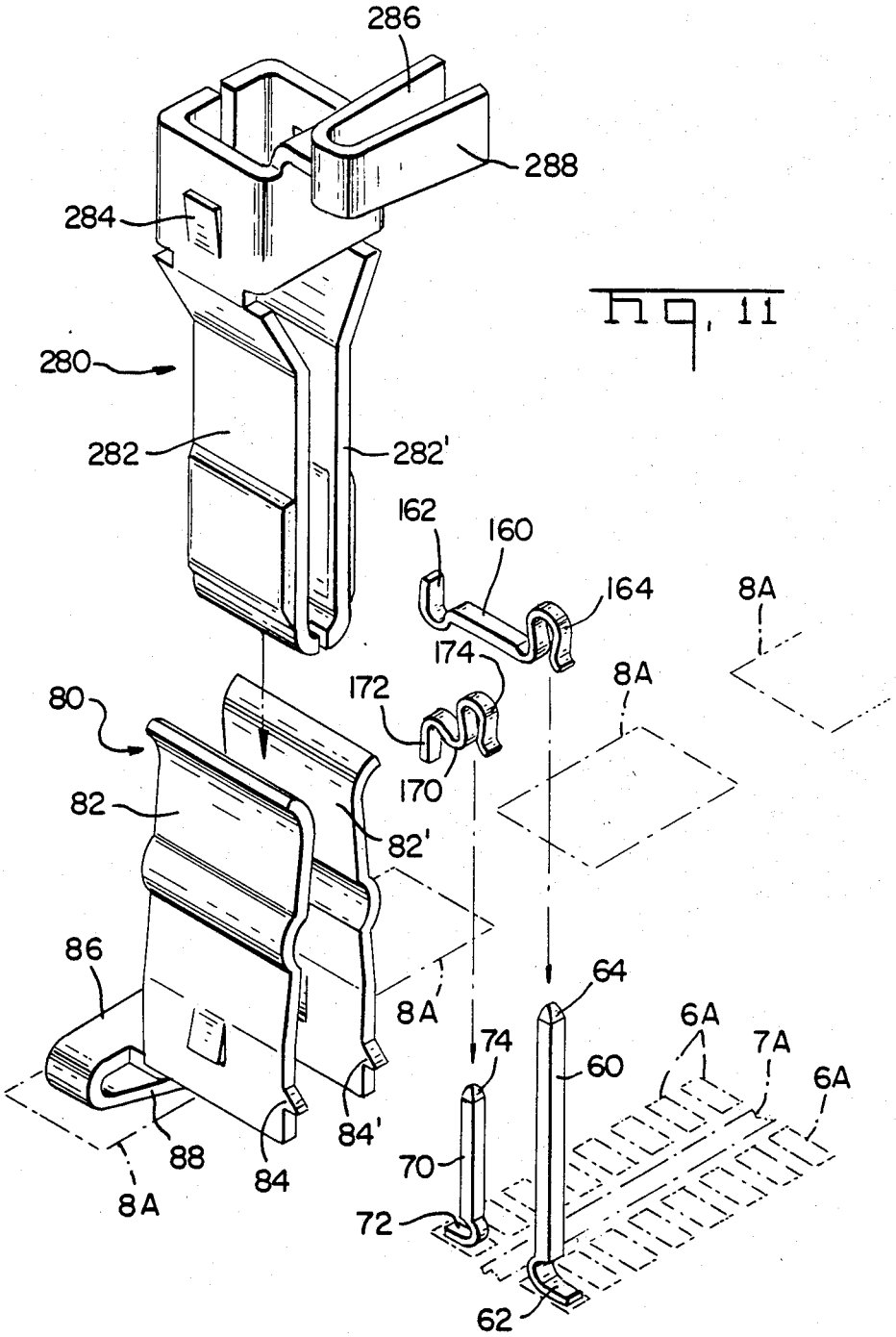
FIG. 11 is an exploded perspective view showing only the terminals used in the mother board and daughter board connectors and showing the relative position of each.

The mating configuration of connectors 10, 100, and 200 is shown in FIG. 7 and in FIGS. 8, 9, and 10, with connectors 100 and 200 attached by means of screws or other conventional fastening elements at the lower edge of the daughter board, the daughter board 2 is insertable into position in the mother board connector 10. Relatively rigid daughter board connectors 100 and 200 are thus secured to opposite sides of the daughter board and will tend to minimize warpage of the relatively thinner daughter board. As shown in FIGS. 1, 2, and 13, flange cavities 32 and 32' provide suitable clearance for the board attachment flanges 132 and 132' on connector 100 and 232 and 232' on connector 200. A cylindrical mating groove 34 and 34' on each side of the mother board housing is dimensioned for close fitting engagement with cylindrical surfaces 134 and 134' at the exterior ends of the metal housing 100. These mating surfaces serve to key and align the connector housing to position corresponding mating terminals in alignment. Precise alignment is especially important because of the large number of closely spaced terminals employed in the two mating connectors. The conical lower portion of surfaces 134 and 134' laterally aligns the signal contacts in both housings. The upper cylindrical surfaces then maintain this precise alignment as the contacts are fully mated. The lower conical portions of the alignment sections 134, 134' extend below the lower surface of the daughter board signal connector 100 and are dimensioned to stub against the mother board connector 10 before the pins 60 and 70 stub against the daughter board connector or contacts 160 and 170. This feature prevents damage to the connectors as a result of an improper attempt to mate them. For example, thermal expansion can result in a significant dimensional mismatch when a new daughter board and connector is inserted into a mother board connector which has been heated during use.

Figure 5:
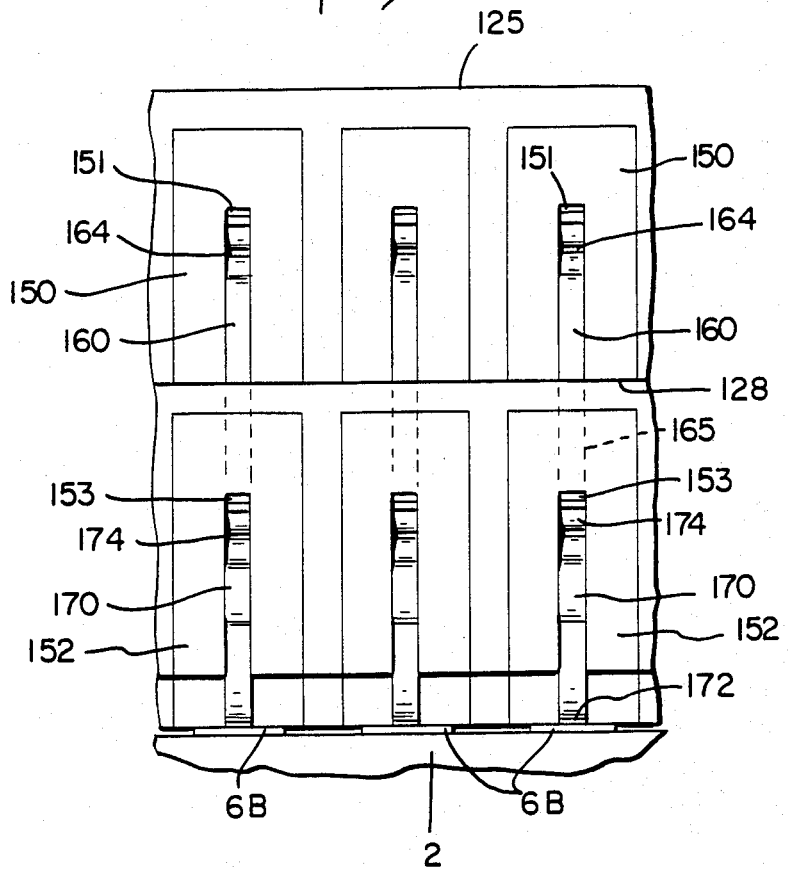
FIG. 5 is a bottom view of the daughter board signal connector.
Figure 6:
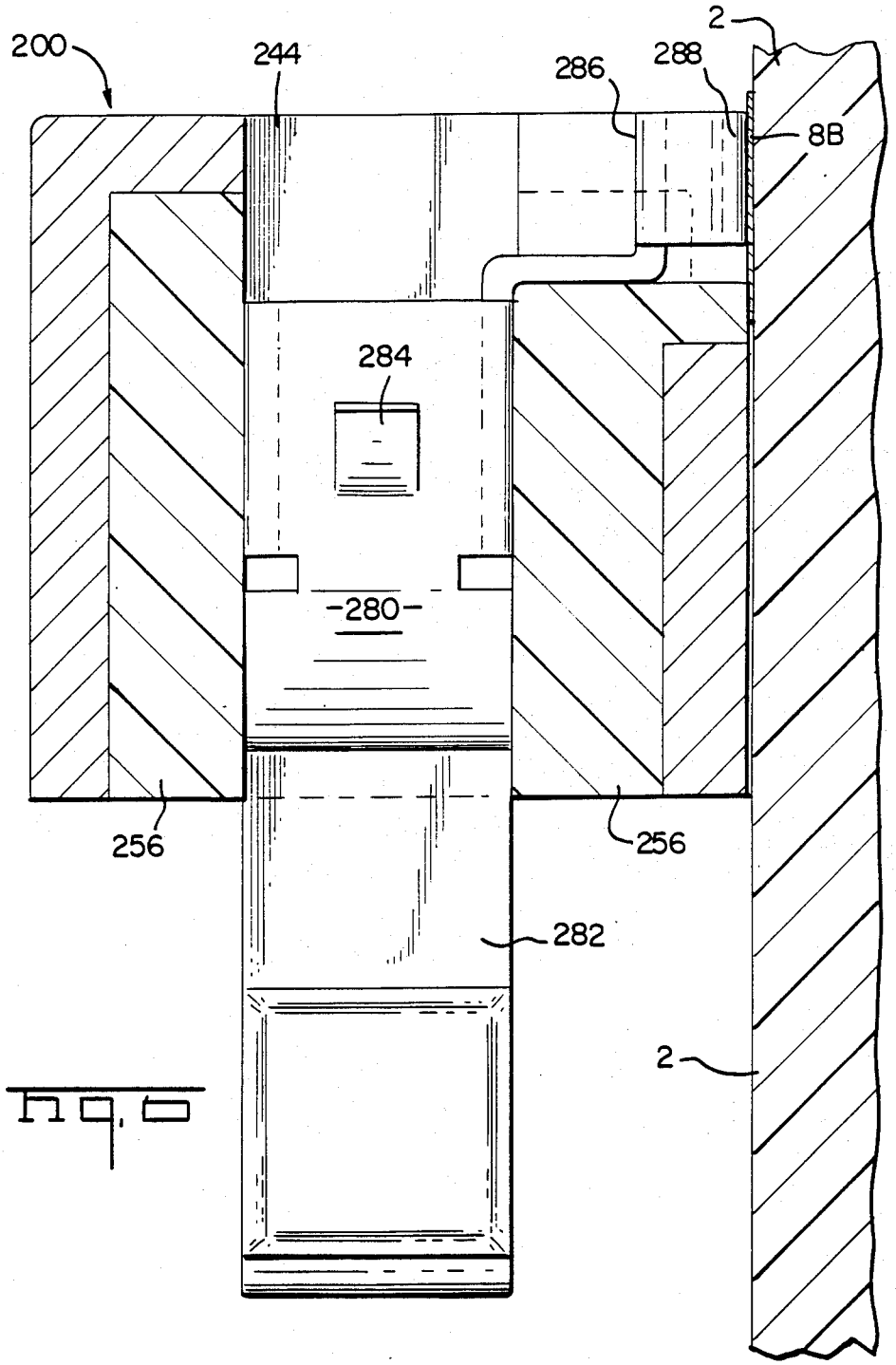
FIG. 6 is an elevational sectional view of the daughter board power connector.

Mating between the terminals in the three connectors is demonstrated in FIG. 7. The tapered ends of the signal terminals 60 and 70 in the mother board connector 10 are received within the resilient sockets 164 and 174 on the signal terminals 160 and 170. In order to provide the right angle interconnection between the orthogonal mother board 4 and daughter board 2, the outer longer mother board signal pins 60 mate with the upper or outer longer signal pins 160 attached to the daughter board. Similarly, signal terminals 70 interconnect with signal terminals 170. When the signal connectors are mated, as shown in FIG. 7, the dielectric sleeves 50 and 150 abut as do the dielectric sleeves 52 and 152 to surround the signal terminals and establish a dielectric between the signal terminals and the surrounding walls of the conductive outer housings 20 and 120. Since the walls 22, 122, 24, and 124, extend into abutment with the printed circuit boards with the connectors attached by solder to the ground plane of the board (see FIGS. 9 and 5), the outer housing surrounds the terminals and the intermediate dielectric sleeves along substantially their entire length. FIGS. 8, 9, and 10 are cross sectional views taken through the signal portions of the intermated connectors to demonstrate the substantial coaxial character of the connectors.

A plurality of springs 90, located in spring retaining slot 92 located on the exterior walls of the mother board connector 10, engages the outer surface of the connector housings 120 and 20. Thus, all three housings are grounded. Suitable interconnection can be established through pads on the printed circuit board to the ground plane in the printed circuit board, thus maintaining the entire housing at the common electrical potential.

The instant invention not only provides a matched impedance interconnection between printed circuit boards, but it also provides for interconnection of extremely closely spaced signal pads. For example, in the preferred embodiment of this invention, adjacent signal pads are spaced apart on 0.050 inch centerlines. Therefore, the terminals must also be spaced apart by the same distance. For a connector having an essentially constant impedance of 50 ohms, signal pockets 40, 42 having a rectangular cross section preferably would have a width of 0.040 inches and a length of 0.090 inches. The walls 22 between adjacent signal terminals would then have a thickness of 0.010 inches. Such relatively thin walls approach if not exceed the capabilities of conventional molding and die casting technology. Even if the unitary signal terminal housings with walls 22, 23, 24, 123, 124, and 125 having a thickness of 0.010 can be fabricated, the cost of making even simple structures would be excessive or prohibitive. Such closely spaced arrangements do not provide adequate room for separate shields or ground planes surrounding each terminal position in an insulated connector housing. By employing a subsequently cast or molded outer housing, this invention achieves the close spacing required.

FIGS. 16–19 show the manner in which a connector housing in accordance with the preferred embodiment of this invention can be constructed. The construction of a portion of the signal terminal array of the mother board housing 10 is illustrated in these fragmentary perspective drawings. It should be understood, however, that in the preferred embodiment of this invention that the entire outer connector housing 10, and not just the signal array, will be either cast or molded as one piece. The initial step in fabricating this connector is the fabrication of the individual dielectric sleeves 50, 52. In the preferred embodiment of this invention, the sleeves are molded. The sleeves may be individually molded or molded as part of a single assembly and interconnected by a carrier strip, all by conventional means. Sleeves molded on separate carrier strips may be interdigitated such that the spacing between adjacent sleeves in the connector will be one half the spacing on the carrier strips. If the sleeves are individually molded, the sleeves must be initially positioned on centerlines corresponding to the terminal centerlines for the connector in question. The dielectric sleeves may also be carried by mold inserts which can be transferred to the die casting apparatus. For individual terminals, this may be done by conventional means such as positioning the sleeves on a comb member. If the dielectric sleeves are formed by single molding with an intermediate carrier strip, the appropriate spacing can be maintained by the carrier strip.

Figure 16:
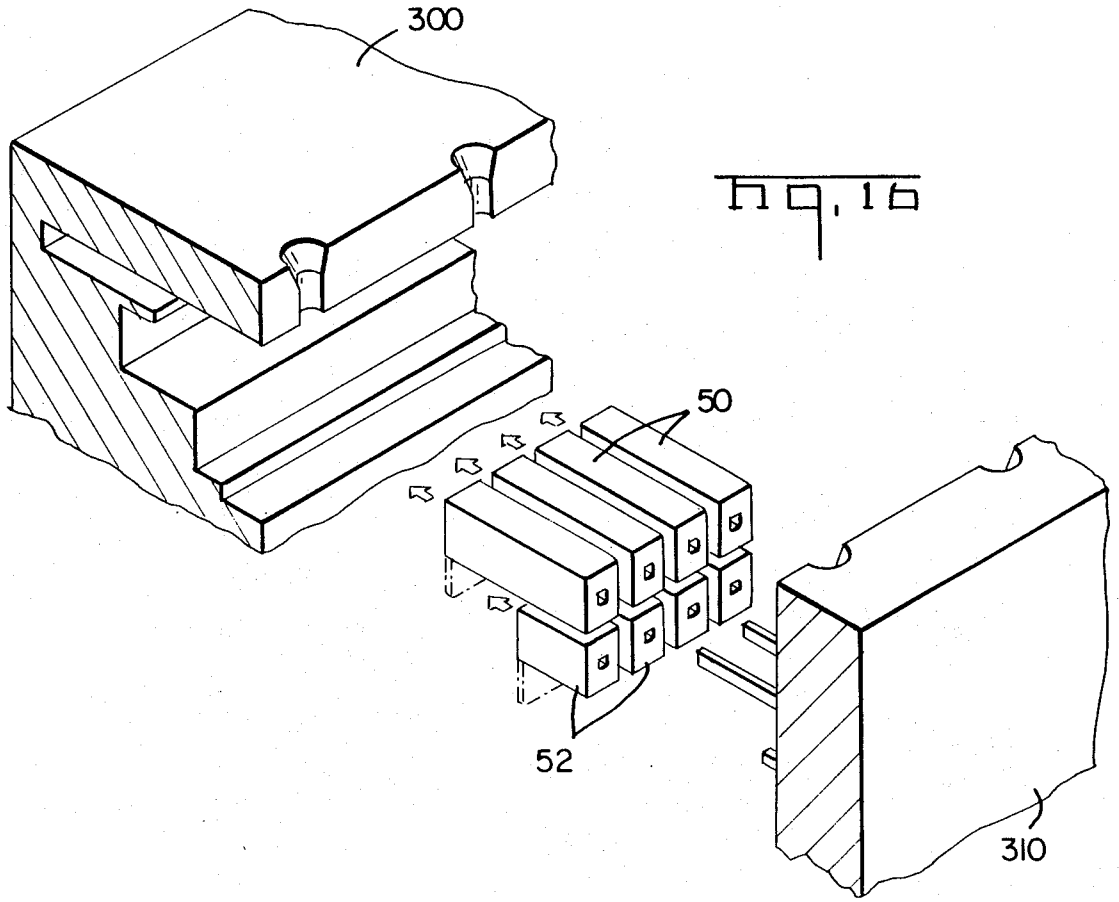
FIGS. 16–19 show the fabrication of the mother board signal connector to illustrate the method of manufacturing the connector.
Figure 17:
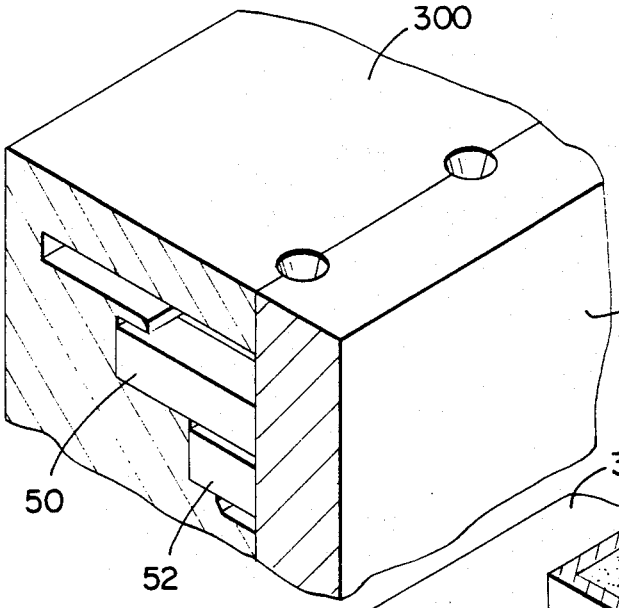
Figure 18:
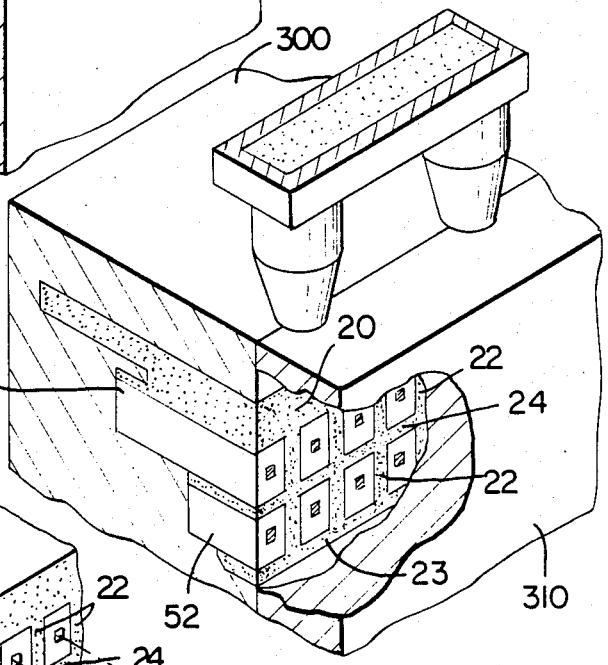
Figure 19:
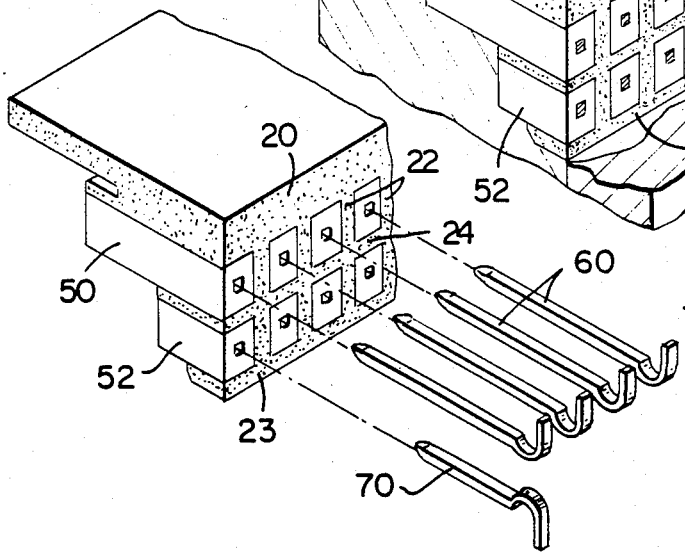
Figure 20:
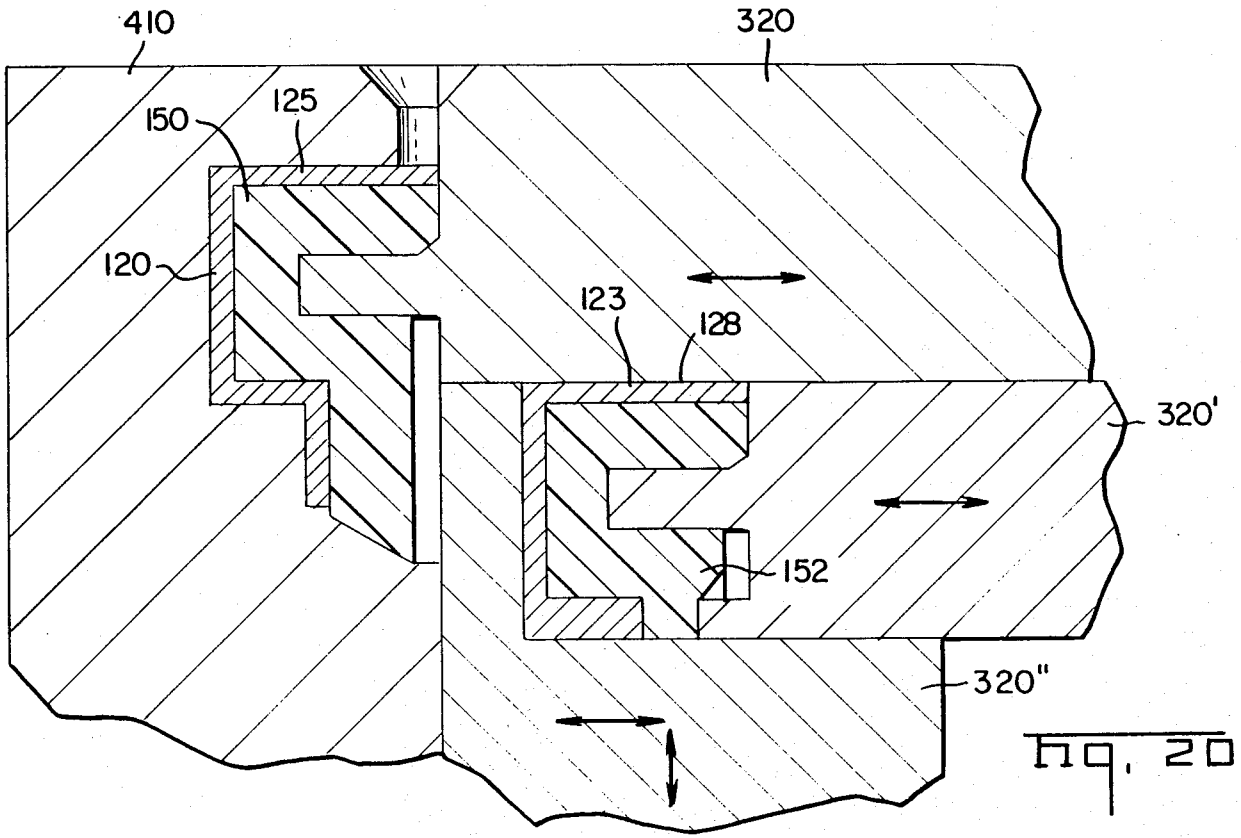
FIG. 20 is a cross-sectional view illustrating the fabrication of the daughter board signal connector.

As shown in FIG. 16, the sleeves on appropriate centerline spacings are first loaded into an outer mold. The two mold halves 300 and 310 are then mated with the dielectric sleeves located in the mold cavity. When the mold halves 300 and 310 are mated as shown in FIGS. 17 and 18, the outer housing can be cast or molded around the separate sleeves. In the preferred embodiment of this invention, the outer housing is formed by a die casting operation. A conductive material is injected into the mold 300. The cast material then fills the mold, including the spaces between the dielectric sleeves to completely encapsulate the sides of the dielectric sleeves. In the preferred embodiment of this invention, the temperature of the molten material cast around the sleeves exceeds the melting temperature of the dielectric material. However, experience has shown that the housing can be successfully cast or molded around the dielectric material. The dielectric sleeves defining the intermediate walls serve to permit the molten conductive material to fill the intermediate space to form the walls, since the heat conductivity into the plastic is less than for a metal mold cavity. By first positioning the dielectric sleeves on appropriate centerlines and then casting or molding the material around the precisely positioned sleeves, tolerances can be maintained. If the outer housing were cast first, it would be difficult to keep the cavities on proper centerlines, where a large number of terminal cavities are in the same row. It should be understood that appropriate core pins can be employed as needed in an entirely conventional manner to define other portions of the structure of the outer housing, not initially defined by the contour of the mold cavity or by the inserted dielectric sleeves. In the preferred embodiment of this invention a conductive material, such as an alloy of 90 percent tin and 10 percent silver, is employed in the fabrication of the outer housing. It should be understood, however, that a conductive plastic might also be employed in a molding operation. After the housing has been removed from the mold, the individual terminals can then be inserted into the terminal receiving cavities in the dielectric sleeves. For the mother board signal terminals 60, which consist essentially of straight pins, insertion of pins 60 into the appropriate cavities is relatively straight forward, as illustrated in FIG. 19. However, the configuration of the signal terminals 160 and 170 in the daughter board connector is more complex. In the preferred embodiment of this invention, the daughter board signal terminals 160 and 170 must be first inserted into sleeves 150 and 152 with the socket portions 164 and 174 laterally inserted into socket cavities 151 and 153. The dielectric insert 154 is then inserted between housing wall 124 and the lower face of the dielectric sleeve 150 as viewed in FIG. 4. Suitable core pins would be employed to prevent the cast outer housings from filling the portion of the terminal receiving pockets into which dielectric sleeve portion 154 is inserted.

Although the terminals are inserted into the terminal receiving cavities after the outer housing is formed around the dielectric sleeves, in the preferred embodiment of this invention, it should be appreciated that the terminals could be inserted into the terminal receiving cavities prior to the casting operation.

This method not only allows fabrication of the relatively thin conductive walls between adjacent dielectric sleeves, but additionally, this invention is especially suited for dimensional compensations which must be made to insure a uniform impedance. The controlled impedance of this invention is not dependent upon a uniform cross sectional shape of either terminals, sleeves, or housings along the length of the signal terminal path between mother board and daughter board. For example, the cross sectional area of the terminals at the interface between the ends 64, 74 of terminals 60 and 70 and the terminal sockets 164 and 174 creates a dimensional discontinuity, However, this invention permits the width of the dielectric to be altered to maintain constant impedance at this point. Since the dielectric sleeve is a molded part, this dimensional modification is taken care of in the molding operation itself. This modification does not result in a complex housing structure since the housing is cast or molded around the previously molded dielectric sleeve. Thus, the fabrication technique employed in this invention is especially adapted to the formation of the complex structures needed to achieve the controlled impedance performance on the closely spaced centerlines exhibited by the referred embodiment of this invention.

Figure 22:
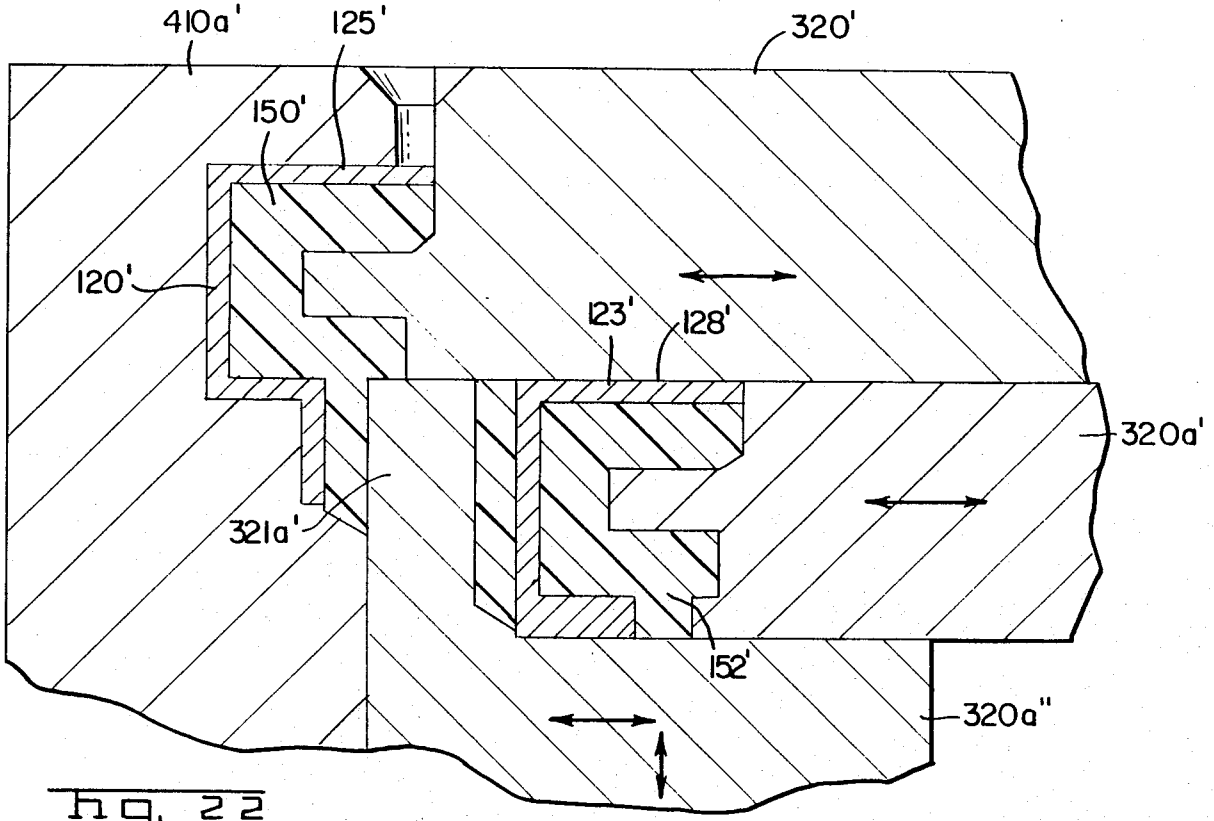
FIG. 22 is a view similar to FIG. 20 illustrating the fabrication of the alternate daughter board connector shown in FIG. 21.
Figure 27:
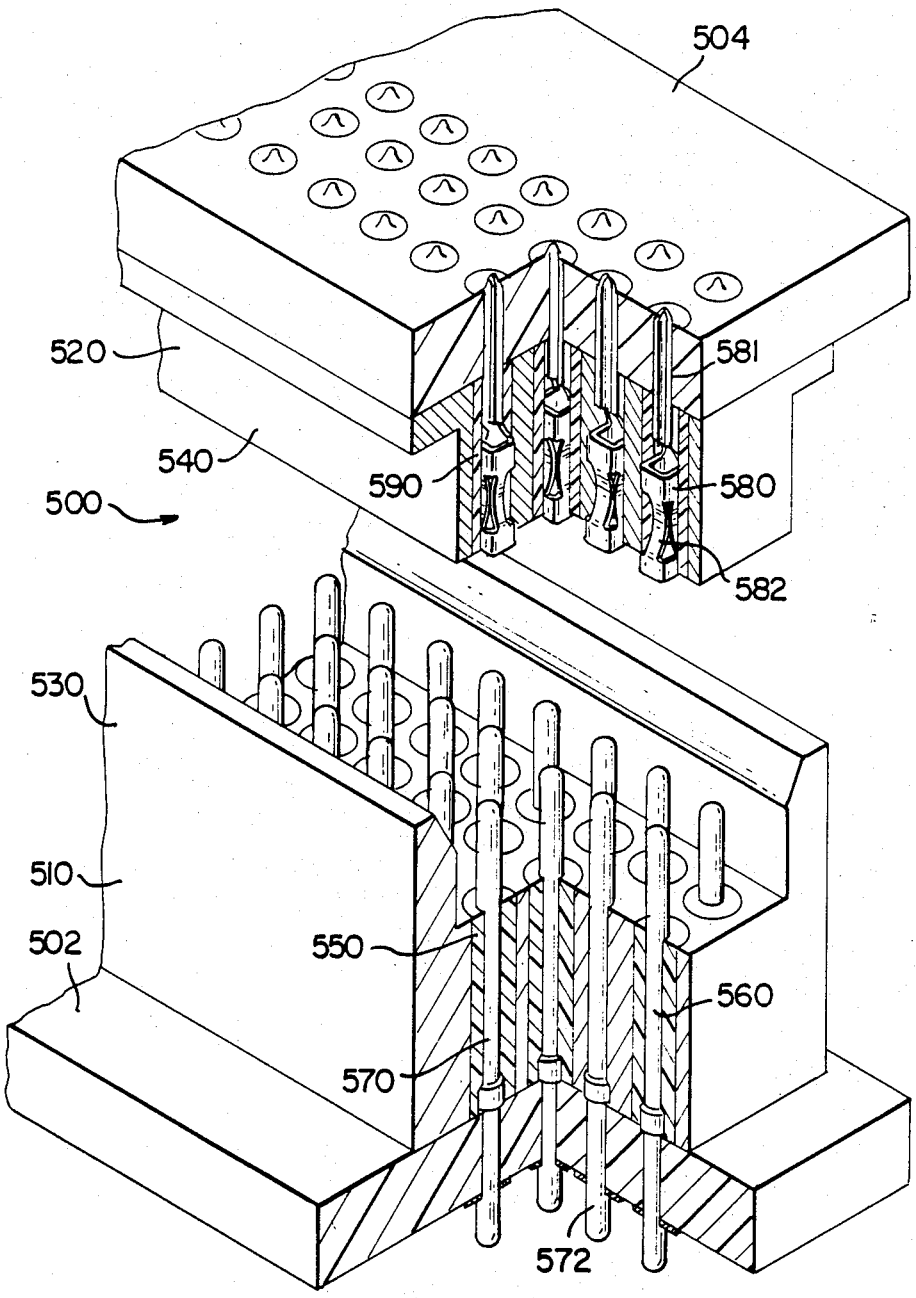

FIG. 21 shows an embodiment of the daughter board signal connector which simplifies insertion of terminal 160' which is identical to terminal 160. The dielectric sleeve 150' has a bore 155' which extends to the left as seen in FIG. 21. The shank 165' extends through the bore 155' but is spaced from the dielectric material 154' which defines bore 155'. FIG. 22 shows the manner in which the core pin extension 321*a'* defines bore 155'.

FIG. 23 shows that the invention described herein is not limited to a mother daughter board configuration. The connector assembly depicted in FIG. 23 constitutes a parallel printed circuit connector assembly 500 consisting of a receptacle connector half 510 and a plug connector half 520 for interconnecting traces between printed circuit boards 502 and 504. The connector halves employ conductive housings 530 and 540 formed around dielectric sleeves 550 and 590.

Pins 570 and receptacle contacts 580 are positioned within the dielectric sleeves. Receptacle contacts 580 have a box contact portion 582 intermatable with one end of pins 560. Through hole leads 581 extend from the box contact portions 582 and can be soldered to traces on the printed circuit board in a conventional manner. Pins 560 also extend from housing 530 for insertion through holes in printed circuit board 502. Ground contacts 572, which do not require dielectric sleeves, are contact with the conductive housing and can be soldered to ground traces in printed circuit board 502.

What is claimed:

1. A multi-contact electrical connector assembly for interconnecting corresponding conductive traces on orthogonal printed circuit boards, comprising:

a first electrical connector having inner and outer terminals aligned in inner and outer rows respectively, the outer terminals being longer than the inner terminals;

inner and outer dielectric sleeves surrounding the inner and outer terminals, the inner and outer terminal ends extending beyond an upper face of the dielectric sleeves;

a first unitary housing formed of a conductive material surrounding and extending between the dielectric sleeves; the upper faces of the dielectric sleeves being exposed;

a second electrical connector having upper and lower terminals aligned in upper and lower rows respectively, each upper and lower terminal having a socket at one end thereof; the upper row being longer than the lower row;

upper and lower dielectric sleeves each one having a socket pocket in a lower face for receiving a corresponding one of said sockets;

a second unitary housing formed from a conductive material extending around the upper and lower dielectric sleeves; the lower faces of the dielectric sleeves being exposed;

the first and second connectors being mated with the inner and outer terminals extending at right angles to and being matable with the lower and upper terminals respectively, the sockets of the lower and upper terminals engaging ends of corresponding inner and outer terminals at the right angle intersections of the terminals; the lower faces of the upper and lower dielectric sleeves abutting the upper faces of the inner and outer dielectric sleeves, the first and second housings having interior and exterior walls individually surrounding each pair of mated terminals along substantially the entire length thereof with the dielectric sleeves forming an annular dielectric between the terminals and the housing walls.

2. The connector assembly of Claim 1 wherein impedance for individual signal paths between corresponding conductive traces on orthogonal printed circuit boards is substantially constant.

3. The connector assembly of Claim 1 wherein the first and second connector housings each comprises unitary cast metal structures.

4. The connector assembly of Claim 1 wherein each terminal has a foot disposed on an exterior surface of the connector assembly, each foot comprising means for establishing a surface mount reflow solder interconnection to a corresponding conductive trace.

* * * * *